United States Patent [19]

Dwire et al.

[11] Patent Number: 4,556,878

[45] Date of Patent: Dec. 3, 1985

[54] DISPLAY OF GRAPHICS USING A NON-ALL POINTS ADDRESSABLE DISPLAY

[75] Inventors: Jerold D. Dwire, Round Rock, Tex.; Donald T. Crehan, Gaithersburg, Md.

[73] Assignee: International Business Machines Corp., Armonk, N.Y.

[21] Appl. No.: 493,578

[22] Filed: May 11, 1983

[51] Int. Cl.[4] ..... G09G 1/00

[52] U.S. Cl. ..... 340/724; 340/722; 340/747; 340/793

[58] Field of Search ..... 340/724, 726, 723, 747, 340/722, 709, 707, 703, 793, 767

[56] References Cited

U.S. PATENT DOCUMENTS

| | | | |
|---|---|---|---|
| 3,509,350 | 4/1970 | Gundrum | 340/707 |
| 3,781,850 | 12/1973 | Gicca et al. | 340/747 |
| 4,467,322 | 8/1984 | Bell et al. | 340/709 |

OTHER PUBLICATIONS

*A Cell Organized Raster Display for Line Drawings* Jordan, Jr., et al.; Comm. of the ACM; pp. 70–77; vol. 17, No. 2, 2/74.

*Primary Examiner*—Marshall M. Curtis
*Attorney, Agent, or Firm*—C. Lamont Whitham; J. B. Kraft; John L. Jackson

[57] ABSTRACT

A processor controlled character box display is provided with apparatus which permits the display of curvilinear graphics. The characters used to generate the graphics display are selected from a limited character set in read only storage (46), but by shifting the characters up or down by less than a full line index to provide additional character positions, it is possible to produce curvilinear graphics without the need for further character generation. Since the graphics display is a low resolution display, it is necessary to make a best dot selection in order to map the print bit map into the character box display.

8 Claims, 10 Drawing Figures

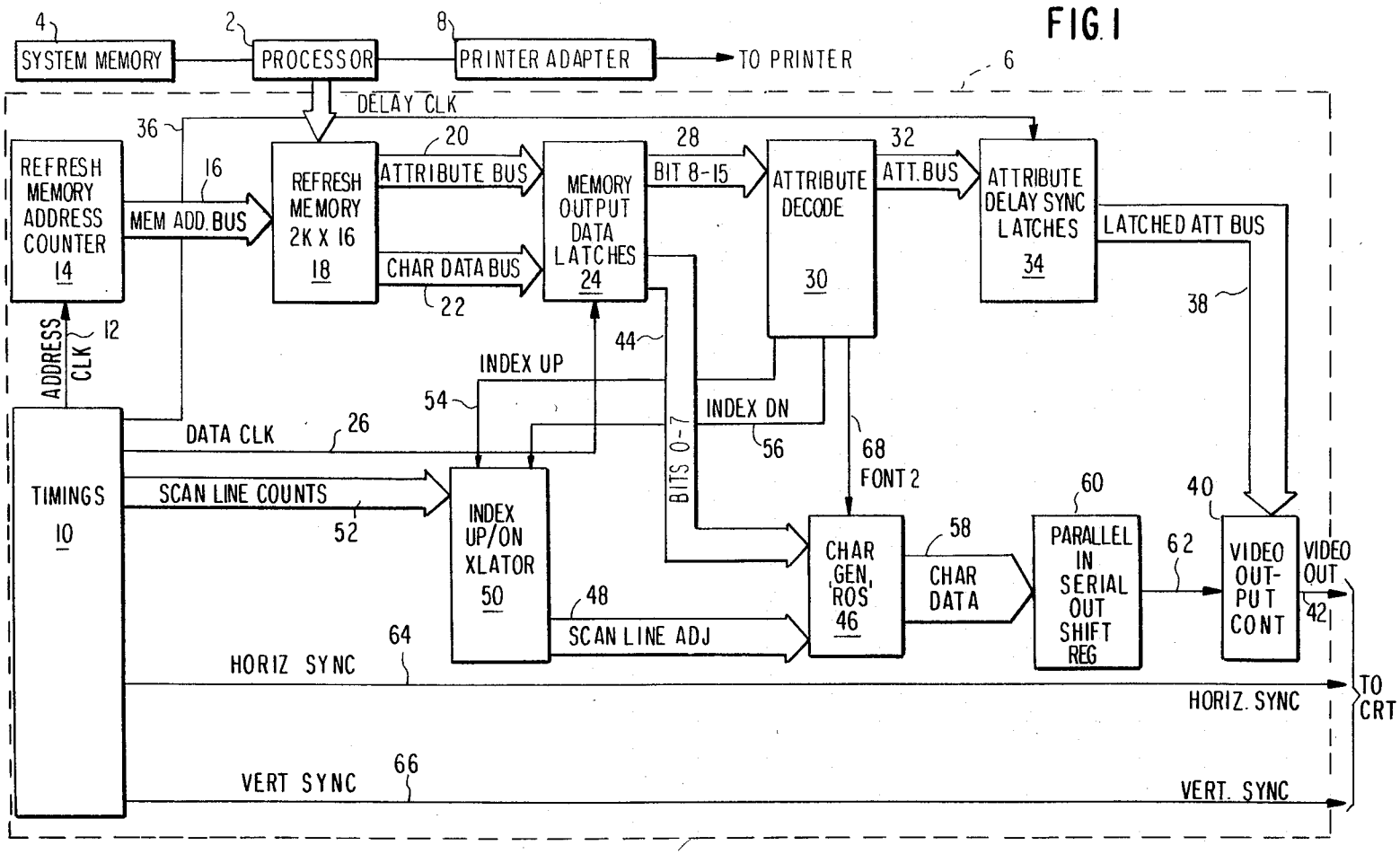
FIG. 1
SYSTEM MEMORY
PROCESSOR
PRINTER ADAPTER
TO PRINTER
DELAY CLK
REFRESH MEMORY ADDRESS COUNTER 14
MEM ADD. BUS
REFRESH MEMORY 2K X 16 18
ATTRIBUTE BUS
CHAR DATA BUS
MEMORY OUTPUT DATA LATCHES 24
BIT 8-15
ATTRIBUTE DECODE 30
ATT. BUS
ATTRIBUTE DELAY SYNC LATCHES 34
LATCHED ATT BUS
ADDRESS CLK
TIMINGS 10
DATA CLK
SCAN LINE COUNTS
INDEX UP
INDEX DN
BITS 0-7
INDEX UP/ON XLATOR 50
SCAN LINE ADJ
FONT 2
CHAR GEN, ROS 46
CHAR DATA
PARALLEL IN SERIAL OUT SHIFT REG
VIDEO OUT-PUT CONT
VIDEO OUT
TO CRT
HORIZ SYNC
VERT SYNC
HORIZ. SYNC
VERT. SYNC

| NORMAL | INDEXED DOWN | INDEXED UP | NORMAL | INDEXED DOWN | INDEXED UP |
|---|---|---|---|---|---|
| ..... | ..... | | ..... | ..... | |
| ...XX... | ..... | | ...OO... | ..... | |
| ...XX... | ..... | | ...OO... | ..... | |
| ..... | ..... | | ..... | ..... | |
| ..... | ...XX... | | ..... | ...OO... | |
| ..... | ...XX... | | ..... | ...OO... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ...XX... | ..... | ..... | ...OO... |
| ..... | ..... | ...XX... | ..... | ..... | ...OO... |
| ..... | ..... | ..... | ..... | ..... | ..... |
| ...XX... | ..... | ..... | ...OO... | ..... | ..... |
| ...XX... | ..... | ..... | ...OO... | ..... | ..... |
| ..... | ..... | ..... | ..... | ..... | ..... |
| ..... | ...XX... | ..... | ..... | ...OO... | ..... |
| ..... | ...XX... | ..... | ..... | ...OO... | ..... |
| ..... | ..... | ..... | ..... | ..... | ..... |
| ...XX... | ..... | | ...OO... | ..... | |
| ..X..X.. | ..... | | ..O..O.. | ..... | |
| ..X..X.. | ..... | | ..O..O.. | ..... | |
| ...XX... | ...XX... | | ...OO... | ...OO... | |
| ..... | ..X..X.. | | ..... | ..O..O.. | |
| ..... | ..X..X.. | | ..... | ..O..O.. | |
| ..... | ...XX... | | ..... | ...OO... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | | ..... | ..... | |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ..... | ..... | ..... | ..... |
| ..... | ..... | ...XX... | ..... | ..... | ...OO... |
| ..... | ..... | ..X..X.. | ..... | ..... | ..O..O.. |
| ..... | ..... | ..X..X.. | ..... | ..... | ..O..O.. |
| ...XX... | ..... | ...XX... | ...OO... | ..... | ...OO... |
| ..X..X.. | ..... | ..... | ..O..O.. | ..... | ..... |
| ..X..X.. | ..... | ..... | ..O..O.. | ..... | ..... |
| ...XX... | ...XX... | ..... | ...OO... | ...OO... | ..... |
| ..... | ..X..X.. | ..... | ..... | ..O..O.. | ..... |
| ..... | ..X..X.. | ..... | ..... | ..O..O.. | ..... |
| ..... | ...XX... | ..... | ..... | ...OO... | ..... |

· = PEL OFF
x = PEL ON
o = PEL ON BRIGHT

FIG. 3

VL = VERTICAL LABEL AREA
HL = HORIZONTAL LABEL AREA
VA = VERTICAL AXIS AREA
HA = HORIZONTAL AXIS AREA
PA = PLOTTING AREA

| | 0 | 1 | 2 | 3 | 4 | 5 | 6 | 7 | 8 | 9 |
|---|---|---|---|---|---|---|---|---|---|---|
| 0 | 0 | 0 | 0 | 5 | 5 | 5 | 5 | 0 | 0 | 0 |
| 1 | 0 | 0 | 0 | 5 | 5 | 5 | 5 | 0 | 0 | 0 |
| 2 | 0 | 0 | 0 | 5 | 5 | 5 | 5 | 0 | 0 | 0 |
| 3 | 0 | 0 | 0 | 5 | 5 | 5 | 5 | 0 | 0 | 0 |
| 4 | 4 | 4 | 4 | 2 | 2 | 2 | 2 | 4 | 4 | 4 |
| 5 | 4 | 4 | 4 | 2 | 2 | 2 | 2 | 4 | 4 | 4 |
| 6 | 4 | 4 | 4 | 2 | 2 | 2 | 2 | 4 | 4 | 4 |
| 7 | 4 | 4 | 4 | 2 | 2 | 2 | 2 | 4 | 4 | 4 |
| 8 | 3 | 3 | 3 | 1 | 1 | 1 | 1 | 3 | 3 | 3 |
| 9 | 3 | 3 | 3 | 1 | 1 | 1 | 1 | 3 | 3 | 3 |
| A | 3 | 3 | 3 | 1 | 1 | 1 | 1 | 3 | 3 | 3 |
| B | 3 | 3 | 3 | 1 | 1 | 1 | 1 | 3 | 3 | 3 |
| C | 4 | 4 | 4 | 2 | 2 | 2 | 2 | 4 | 4 | 4 |
| D | 4 | 4 | 4 | 2 | 2 | 2 | 2 | 4 | 4 | 4 |
| E | 4 | 4 | 4 | 2 | 2 | 2 | 2 | 4 | 4 | 4 |
| F | 4 | 4 | 4 | 2 | 2 | 2 | 2 | 4 | 4 | 4 |
| 10 | 0 | 0 | 0 | 5 | 5 | 5 | 5 | 0 | 0 | 0 |
| 11 | 0 | 0 | 0 | 5 | 5 | 5 | 5 | 0 | 0 | 0 |
| 12 | 0 | 0 | 0 | 5 | 5 | 5 | 5 | 0 | 0 | 0 |
| 13 | 0 | 0 | 0 | 5 | 5 | 5 | 5 | 0 | 0 | 0 |

FIG.6

1 = HIGHEST PRIORITY

5 = LOWEST PRIORITY

0 = NOT CONSIDERED (IGNORED)

FIG.7

| | | |
|---|---|---|
| 0000000000 | 0000000000 | 0000000000 |
| 0000000000 | 0000000000 | 0000000000 |
| 0000000000 | 0000000000 | 0000000000 |
| 0000000000 | 0000000000 | 0000000000 |
| 0000000000 | 0001111000 | 0000000000 |
| 0000000000 | 0001111000 | 0000000000 |
| 0000000000 | 0001111000 | 0000000000 |
| 0000000000 | 0001111000 | 0000000000 |
| 0001111000 | 0000000000 | 0000000000 |
| 0001111000 | 0000000000 | 0000000000 |
| 0001111000 | 0000000000 | 0000000000 |
| 0001111000 | 0000000000 | 0000000000 |
| 0000000000 | 0000000000 | 0000000000 |
| 0000000000 | 0000000000 | 0000000000 |
| 0000000000 | 0000000000 | 0000000000 |
| 0000000000 | 0000000000 | 0000000000 |
| 0000000000 | 0000000000 | 0001111000 |
| 0000000000 | 0000000000 | 0001111000 |
| 0000000000 | 0000000000 | 0001111000 |
| 0000000000 | 0000000000 | 0001111000 |
| MASK 1 | MASK 2 -------- | MASK II |

FIG. 8
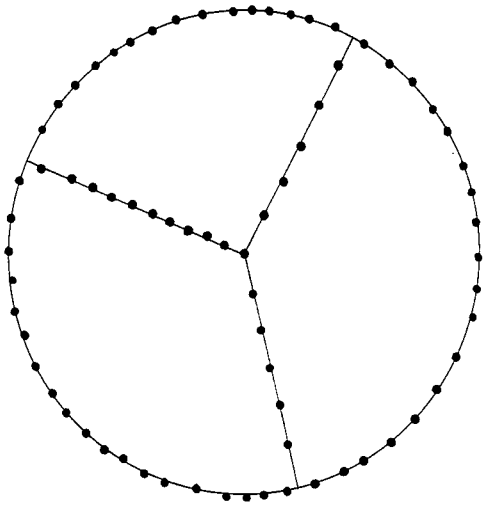
| | 0 | 1 | 2 | 3 | 4 | 5 | 6 | 7 | 8 | 9 |
|---|---|---|---|---|---|---|---|---|---|---|
| 0 | 4 | 4 | 4 | 4 | 4 | 4 | 4 | 4 | 4 | 4 |
| 1 | 4 | 4 | 4 | 4 | 4 | 4 | 4 | 4 | 4 | 4 |
| 2 | 4 | 4 | 4 | 4 | 4 | 4 | 4 | 4 | 4 | 4 |
| 3 | 4 | 4 | 4 | 4 | 4 | 4 | 4 | 4 | 4 | 4 |
| 4 | 2 | 2 | 2 | 2 | 2 | 2 | 2 | 2 | 2 | 2 |
| 5 | 2 | 2 | 2 | 2 | 2 | 2 | 2 | 2 | 2 | 2 |
| 6 | 2 | 2 | 2 | 2 | 2 | 2 | 2 | 2 | 2 | 2 |
| 7 | 2 | 2 | 2 | 2 | 2 | 2 | 2 | 2 | 2 | 2 |
| 8 | 1 | 1 | 1 | 1 | 1 | 1 | 1 | 1 | 1 | 1 |
| 9 | 1 | 1 | 1 | 1 | 1 | 1 | 1 | 1 | 1 | 1 |
| a | 1 | 1 | 1 | 1 | 1 | 1 | 1 | 1 | 1 | 1 |
| b | 1 | 1 | 1 | 1 | 1 | 1 | 1 | 1 | 1 | 1 |
| c | 3 | 3 | 3 | 3 | 3 | 3 | 3 | 3 | 3 | 3 |
| d | 3 | 3 | 3 | 3 | 3 | 3 | 3 | 3 | 3 | 3 |
| e | 3 | 3 | 3 | 3 | 3 | 3 | 3 | 3 | 3 | 3 |
| f | 3 | 3 | 3 | 3 | 3 | 3 | 3 | 3 | 3 | 3 |
| 10 | 5 | 5 | 5 | 5 | 5 | 5 | 5 | 5 | 5 | 5 |
| 11 | 5 | 5 | 5 | 5 | 5 | 5 | 5 | 5 | 5 | 5 |
| 12 | 5 | 5 | 5 | 5 | 5 | 5 | 5 | 5 | 5 | 5 |
| 13 | 5 | 5 | 5 | 5 | 5 | 5 | 5 | 5 | 5 | 5 |
FIG. 9
FIG. 10
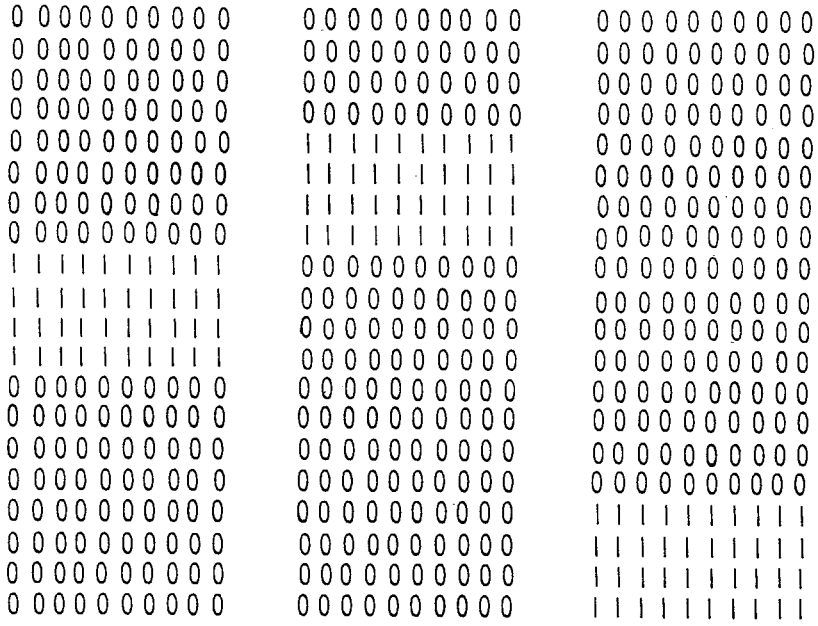
MASK 1 MASK 2 --------- MASK 5

DISPLAY OF GRAPHICS USING A NON-ALL POINTS ADDRESSABLE DISPLAY

RELATED APPLICATION

This application is related to the following concurrently filed application which is assigned to a common assignee and is incorporated herein by reference:

Application Ser. No. 06/493,677, filed May 7, 1983, by Danny B. Convis, Donald T. Crehan and Charles J. Lovell and entitled "Internal Image and Bit Array for Display and Printing of Graphics".

FIELD OF THE INVENTION

This invention generally relates to word processing systems, and more particularly to the display of graphics such as pie and line charts using a non-APA (All Points Addressable) display.

BACKGROUND OF THE INVENTION

Word processing systems have evolved from relatively simple text processors which facilitated the manipulation of character strings to the sophisticated multitasking processors of today which are capable of such diverse applications as communications, calculations and data processing emulations. It is not uncommon, for example, to provide a word processing system with a calculation application to include the generation of graphics data based on calculated or input numerical data. This is because it is often easier to interpret the numerical data when it is presented as a bar, pie or line graph, for example.

The problem arises, however, in the presentation of the graphics data. Generally, the visual display of graphics data on a CRT display has been accomplished with an APA display. Word processing systems typically use a character box or non-APA display. The advantage of the character box display is that it requires much less memory than an APA display of even moderate resolution. The disadvantage is so far as the presentation of graphics data is concerned is the inability of the character box display to support the display of characters not defined by the character box.

The above referenced application Ser. No. 06/493,677 entitled "Internal Image and Bit Array for Display and Printing of Graphics" discloses an apparatus which provides a word processing system using a non-APA display and a letter quality printer, both character box devices, with the ability to both display and print graphics data. The invention described in that application provides an internal image and bit array apparatus to contain the data structures necessary and sufficient to both display and print the graphics data. These data structures are (1) output by the process that converts numeric data values into image data and (2) input to the display process and the print process. These are the central mechanisms that make graphics on a character box device possible. However, in order for these mechanisms to produce a display of graphics data, it is necessary to map the high resolution graphics data in the bit array into the internal image and then to use as few characters as possible selected from a limited character set in read only storage (ROS) in order to display curved lines.

SUMMARY OF THE INVENTION

It is therefore and object of the present invention to provide a character box display with the ability to display curvilinear graphics using a minimum number of characters stored in read only storage.

It is another object of the invention to provide a technique for mapping high resolution graphics data in a print bit array into a lower resolution internal image array for display on a non-APA display.

According to the invention, the objects of the invention are accomplished by shifting characters up or down by less than a full line index to thereby provide additional character positions. This makes it possible to produce curvilinear graphics without the need for additional character generation. For producing a pit chart, four graphics characters are used, each at a different position within the character box. Typically, these are dots which, when shifted up or down using superscript or subscript techniques, produce a total of eleven different dot positions. For producing line charts, two more graphics characters are used. Typically, these are open circles such as a degree symbol which may be moved up or down to produce five different symbol positions. By introducing normal brightness and high brightness to the displayed dot and open circle symbols, it is possible to display four line graphs. Using dot and open circle graphics characters, only four additional characters need to be added to the character generator ROS since at least one dot, the period, and at least one open circle, the degree symbol, already exist in ROS. As a result, the addition of the graphics display capability is achieved with a minimum of additional hardware and software since the subscript and superscript facilities are already available.

Since the graphics display is a low resolution display, it is necessary to make a best dot selection in order to map the print bit array into the internal image array. This is done by examining each cell of the bit array corresponding to a character box on the display to determine which of the eleven pie characters or which of the five line characters is the "best dot" to represent the fragment of the circle or line passing through the cell. In the case of the pie chart, eleven zones are defined, and a bit mask is defined for each of the eleven zones. Then the cell containing the fragment is logically ANDed with each of the eleven masks in a priority order. The first logical AND of the cell with a mask that produces a non-zero result indicates that the circle or line fragment in the cell is intersecting that zone. Then that one of the eleven glyphs that corresponds to that zone is placed in the internal image array as the "best dot" to represent the fragment. The line chart is handled similarly. There are five zones and five masks since there are five glyphs effectively for each of the four line types.

BRIEF DESCRIPTION OF THE DRAWINGS

The foregoing and other objects, aspects and advantages of the invention will be better understood from the following detailed description with reference to the accompanying drawings, in which:

FIG. 1 is a block diagram of a word processing system in which the present invention is embodied;

FIG. 3 is an illustration of the line chart characters in the display character generator ROS;

FIG. 6 is an illustration of the best dot zones of a pie chart;

FIG. 7 is an illustration of the best dot bit masks of the pie chart;

FIG. 8 shows how the eleven dot positions for the pie chart can be used to display a satisfactory outline of a pie chart of any other curvilinear line;

FIG. 9 is an illustration of the best dot zones of a line chart; and

FIG. 10 is an illustration of the best dot zones and bit masks of the line chart.

DETAILED DESCRIPTION OF THE INVENTION

Figure 2:
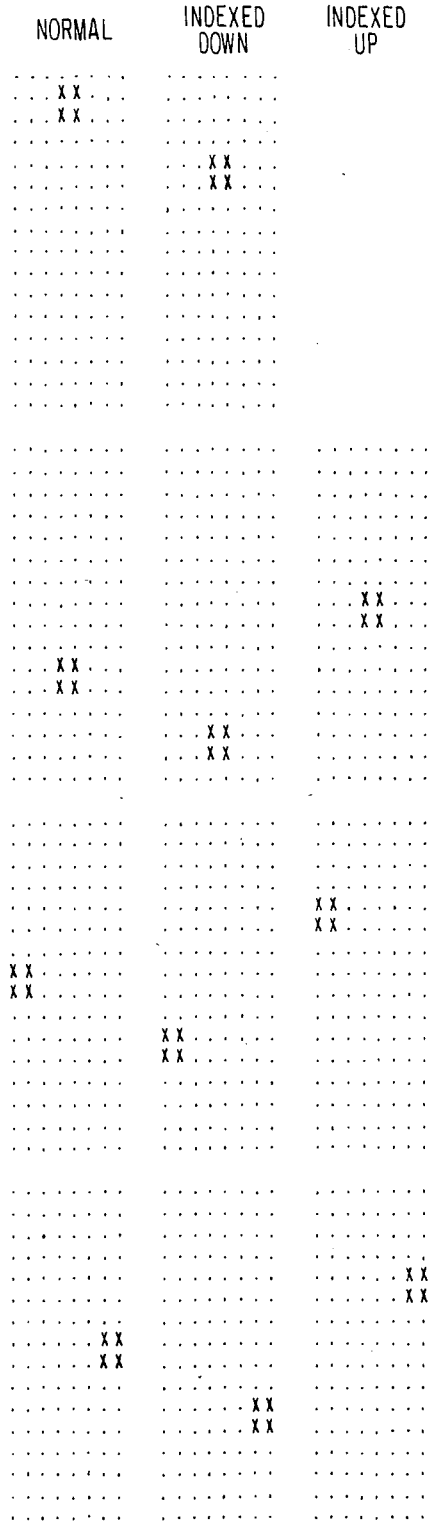
FIG. 2 is an illustration of the pie chart characters in the display character generator ROS.

Referring now to the drawings, and more particularly to FIG. 1, there is shown a block diagram of a typical implementation of a word processor in which the present invention is embodied. The system includes a processor 2, a system memory 4, a display adaptor 6, and a printer adaptor 8. The system memory 4 contains the bit array and the internal image array which are described in more detail hereinafter. Only those connections between processor 2, system memory 4 and the display adaptor 6 are shown as needed for purposes of explanation of the invention, all other interconnections therebetween being well understood by those skilled in the art.

In the display adaptor 6, the timings block 10 provides various clocking signals for the word processor display function. The address clock signal on line 12 is input to refresh memory address counter 14 whose output appears on memory address bus 16. The address on bus 16 is input to the refresh memory 18. Attribute bus 20, as well as character data bus 22, are two outputs from refresh memory 18. The data on both buses 20 and 22 are latched into memory output data latches 24. Another clock signal from the timings block 10 is the data clock on line 26 which is input to data latches 24 for controlling input thereto. Eight bits on bus 28 are output from latches 24 to attribute decoder 30. Once decoded, attribute data is output on bus 32 and is input to attribute delay synchronization latches 34 under control of delay clock signals on line 36. The output of output control 40 on line 42 is the video input to the CRT display monitor (not shown).

The other eight bits of character data are output from memory output data latches 24 along bus 44 to the character generator ROS 46. The character generator ROS 46 also receives scan line adjustment data on bus 48 from index up or down translator 50 and input Font2 on line 68 from attribute decoder 30. The translator 50 receives the scan line count on bus 52 from the timings block 10 and is controlled by signals from attribute decoder 30 on lines 54 and 56 to index up or down in order to provide superscript and subscript functions. The character data output on bus 58 from the character generator ROS 46 is read into a parallel in, serial out shift register 60. The serial character data strings are read out of shift register 60 on line 62 to the video output control 40. The timings block 10 also provides horizontal sync and vertical sync signals on lines 64 and 66 to the display CRT.

In order to understand the invention, one must first understand the constraints of the character box (non-APA) display to which the apparatus according to the invention is tailored. Each character box on the display is 16 pels high and 8 pels wide. The display character generator ROS 46 contains a character font wherein each character is constrained to this character box. Each character box on the display is represented by a two byte character-attribute pair. In other words, the first byte on bus 22 defines the character address in ROS 46, and the second byte on bus 20 specifies the attribute of the displayed character. The bits of the attribute byte are defined as follows beginning with the most significant bit and continuing to the least significant bit:

Line End
*Half Index Up
*Half Index Down
Reverse Video
Underscore
Cursor
*Font2 (there are two fonts in the ROS of 256 symbols each)
*Bright The attribute bits marked with an asterick (*) are used in the apparatus according to the invention.

There are four characters defined in the display character generator ROS 46 used to represent pie charts on the display. These are dots of 2 pels high and 2 pels wide positioned at different locations within the character box. These together with the attributes index up and index down provide a total of eleven effective dot characters as shown in FIG. 2 to outline the rim and spokes of the pie. The reason that there are not twelve effective dot characters is that the twelfth character falls outside the character box. This is illustrated in FIG. 2.

There are basically four characters defined in the display character generator ROS 46 used to represent line charts on the display. These together with the attributes index up, index down and bright provide a total of twenty effective characters (five for each of the four line types) used to give a dot outline representation of lines on the display. These are shown in FIG. 3.

Figure 4:
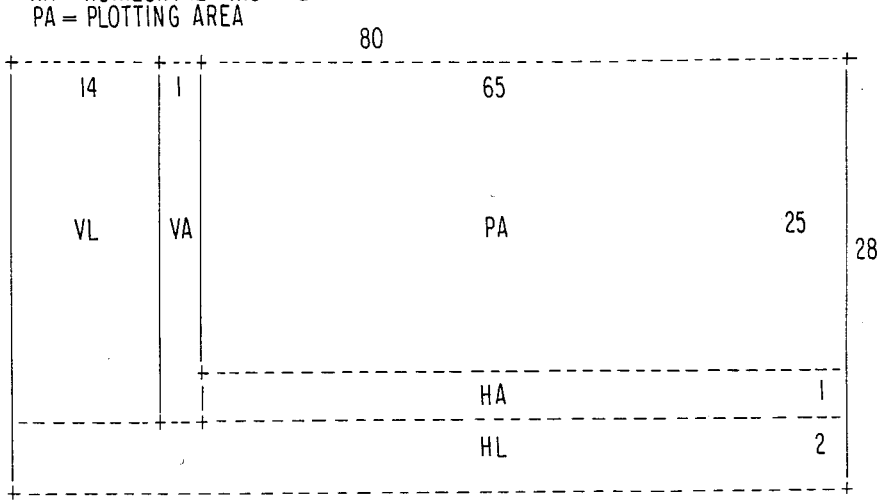
FIG. 4 shows the internal image data structure.
Figure 5:
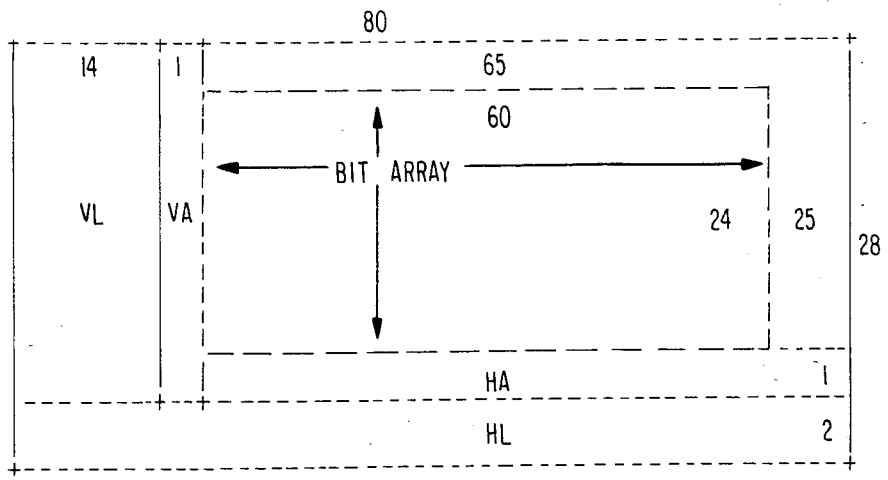
FIG. 5 shows the positional relationship between the internal image data structure and the bit array with the bit array being positioned over the plotting area of the internal image.

The apparatus according to the invention described in the above referenced application Ser. No. 06/493,677 entitled "Internal Image and Bit Array for Display and Printing of Graphics" consists of two data structures in the system memory 4 that are closely linked. The first is the internal image structure. It is shown in FIG. 4 and is a three dimensional matrix. It is 28 character boxes high and 80 character boxes wide, where each box contains two bytes. These two bytes correspond to the fact that each box in the character box display requires a character-attribute byte pair. The second data structure is the bit array data structure shown in FIG. 5 and is also a three dimensional matrix. It is 24 character boxes high and 60 character boxes wide, where each character box contains 25 bytes. The 25 bytes contain the 200 dots of the $20\times10$ print resolution dot matrix of the corresponding character position in the internal image data structure. FIG. 5 shows the positional relationship between the two data structures, the bit array being positioned over the plotting area of the internal image. In the case of pie charts, the rim and spokes of the pie are "written" into the bit array by turning on bits in that array that correspond to those objects. However, the alphanumeric labels of each slice are "written" into the corresponding cells of the internal image. When it is necessary to display the pie chart, the bit array is scanned and a set of "best dot" glyphs are selected and put in the internal image so as to form a "dot outline" of the pie. The display viewer sees its alphanumeric labels and the dot outline of the pie together on the screen.

A "best dot" selection process is used to map the print bit map in the bit array into the internal image character box display for both pie and line charts. It should be understood that the character box display can not possibly show the chart with a resolution comparable to that of the printer. In the character box environment, there are a number of restrictions by virtue of the character box hardware. Specifically, the character box in the display is 16 pels high and 8 pels wide while in the printer, it is effectively 20 pels high and 10 pels wide. In the display, there are four characters which when indexed up and down, provide eleven possible positions within the character box to outline the rim and spokes of a pie chart, and there are four characters which when brightened and/or indexed up and down provide twenty glyphs to outline the segments of lines in a line chart. For both the pie chart and the line chart, the circle and straight line segments are drawn into a print resolution bit map that corresponds to the central plotting area of the chart. This print resolution bit map is used whe printing so that the image is printed in high resolution. The bit map is 60 character box cells wide (600 pels) and 24 character box cells high (480 pels). Each 20×10 cell of that plotting area corresponds to a character box on the display and is examined to determine which of the eleven pie characters or which of the five line characters is the "best dot" to represent the fragment of circle or line passing through that 20×10 area of the bit map. In the case of the pie chart, eleven zones (each 20×10 in size) are defined as shown in FIG. 6. A bit mask is defined for each of the eleven zones as shown in FIG. 7. Then the cell containing the fragment is logically ANDed with each of the eleven masks in a priority order. The central zone is first, the zones immediately above and below it are next, and so on, the priority order of the zones being given by the numbers 1 through 5 in FIG. 6. The first logical AND of the cell with a mask that produces a non-zero result indicates that the circle or line fragment in the cell is intersecting that zone. Then that one of the eleven glyphs that corresponds to that zone is placed in the internal image array in system memory 4 as the "best dot" to represent that fragment. The assignments correspond to a "center is best" policy. FIG. 8 shows how the eleven different dot positions can be used to display a satisfactory outline of a pie chart or, for that matter, any curvilinear line.

Line charts are handled similarly. There are five zones as shown in FIG. 9 and five masks as shown in FIG. 10 since there are five glyphs effectively for each of the four. When it is necessary to display the line chart, the bit array is scanned using these masks to select a set of "best dot" glyphs that are put into the internal image array in the system memory 4. The display viewer sees the line chart alphanumeric labels and axes and the dot outline of the lines together on the screen.

The cells and zone masks are implemented as 25 contiguous bytes (10×20=200 bits) so that they can be addressed by a simple increment of 1 in a DO LOOP. This facilitates testing of the 25 cell bytes to determine if calculation of a best dot is necessary and in the ANDing of each of the 25 bytes of a mask with each of the 25 bytes of the cell to determine if an intersection occurred during the best dot selection.

By using the superscript and subscript apparatus of the word processor, the present invention makes it possible to display curvilinear lines on a character box display using a minimum of additional characters added to the character generator ROS. A lower resolution but still quite acceptable display is made possible by mapping the high resolution print data in the bit array into the internal image array using a "best dot" selection criteria.

The best dot selection process was implemented using a Program Design Language (PDL). An understanding of PDL may be had by reference to an article entitled "Top-down Development Using a Program Design Language" by P. Van Leer, IBM Systems Journal, vol 15, no. 2, (1976) pp. 155–170. The PDL description of the best dot selection process is presented below:

```
*                    SCAN BIT ARRAY FOR NON-BLANK CHARBOXS AND
*                      PUT BEST-DOT GLYPHS FOR THEM INTO II
*                    BEGIN SCAN
 BEGIN SCAN
*
*                    1.  SET CONSTANTS
   IIHA=3                 HORIZONTAL OFFSET FROM BOTTOM OF
                            INTERNAL IMAGE TO BOTTOM OF BIT
                            ARRAY
   IIVA=3                 VERTICAL OFFSET FROM LEFT EDGE OF
                            INTERNAL IMAGE TO LEFT EDGE OF BIT
                            ARRAY
    BAW=60                BIT ARRAY WIDTH
```

```
BAW=24                BIT ARRAY HEIGHT
BAD=25                BIT ARRAY DEPTH (BYTES PER CELL)
*                 1. WHILE I=1 TO HEIGHT BIT ARRAY(LINES) DO
DO I=1 TO BAH
*                 2. . WHILE J=1 TO WIDTH OF BIT
                        ARRAY(CHARS) DO
  DO J=1 TO BAW
*                 3. . . CALC ROW INDEX OF II
    IROW=IIHA+I
*                 3. . . CALC COL INDEX OF II
    ICOL=IIVA+J
*                 3. . . IF II(IROW,ICOL) DOES NOT HAVE
                          SOMETHING IN IT ALREADY, THEN
    IF II(IROW,ICOL,1)=BLANK THEN
*                       MAKE PRELIMINARY CHECK FOR ANY BITS
                        IN CHARBOX (I,J)
*                 4. . . . CALCULATE NUMBER OF BYTES IN
                              PRECEEDING ROWS AND THE
                              PRECEEDING COLUMNS OF THIS ROW
     BAPT=BAD*(BAW*(I-1)+(J-1))
*                 4. . . . OR-SUM ALL 25 BYTES THAT CORRES-
                              POND TO THIS CHARBOX
     TMP=Ø
     K=Ø
     DO UNTIL (K=>BAD) OR (TMP-=Ø)
       K=K+1
       TMP=TMP OR BA(BAPT+K)
     ENDDO
*                 4. . . . IF SOME BITS ON IN CHARBOX I,J
                              THEN
     IF TMP-=Ø THEN
*                 5. . . . . INVOKE BDOT TO FIND APPROPRIATE
                                BEST DOT GLYPH AND INSERT IT
                                INTO THE II
       DO BDOT
*                .4. . . . ENDIF
     ENDIF
*                 3. . . ENDIF
   ENDIF
```

```
*                    2. . ENDDO
     ENDDO
*                    1. ENDDO
   ENDDO
*                    ENDSCAN
 ENDSCAN
*                    FIND BEST DISPLAY DOT TO REP CHARBOX
*                    BEGIN BDOT
 BEGIN BDOT
*
*                    1. SET CONSTANTS
   BABR=20                NUMBER OF BIT ROWS IN ONE CELL
   BABC=10                NUMBER OF BIT COLS IN ONE CELL
   LTYP=1..4              LINE TYPE (1 OR 2 OR 3 OR 4)
*                    1. SET INDEX INTO ARRAY OF MASKS BASED ON
                          CHART TYPE. THE ARRAY, 'ZMSK' IS 16 X
                          25 (= 11 PIE MASKS + 5 LINE MASKS BY
                          25 BYTES PER MASK) WITH BINARY 1'S
                          IN POSITIONS CORRESPONDING TO THE
                          ZONE REPRESENTED BY THE MASK AND
                          BINARY 0'S ELSEWHERE
*                    1. IF TYPE IS LINE, THEN
   IF CHART-TYPE=LINE THEN
*                    2. . SET 'IDEL' TO LINE ZONE MASKS
     IDEL=11
*                    1. ELSE TYPE IS PIE
   ELSE
*                    2. . SET 'IDEL' TO PIE ZONE MASKS
     IDEL=0
*                    1. ENDIF
   ENDIF
*                    1. INIT FIRST ZONE TESTED
   L=1
*                    1. UNTIL INTERSECT FOUND OR ALL 11 PIE
                          ZONES CHECKED OR ALL 5 LINE ZONES
                          CHECKED, DO
   UNTIL (TMP-=0) OR
     ((L>11) AND (CHART-TYPE=PIE)) OR
     ((L>5) AND (CHART-TYPE=LINE)) DO
```

```
*                    2. . TEST FOR INTERSECT WITH ZONE=L
*
*                    2. . UNTIL A NON-Ø BYTE FOUND IN THE
                           CHARBOX OF 25 BYTES OR UNTIL ALL 25
                           BYTES HAVE BEEN EXAMINED, DO
     K=Ø
     UNTIL (TMP-=Ø) OR (K>=BAD) DO
*                    3. . . LOOK AT NEXT BYTE
       K=K+1
*                    3. . . 'AND' ONE OF THE 25 BYTES OF THE
                             BIT ARRAY FOR THIS CHARBOX WITH
                             CORRESPONDING ONE OF THE 25
                             BYTES OF THE MASK BEING TESTED
       TMP=BA(BAPT+K) AND ZMSK(L+IDEL,K)
*                    2. . ENDDO
     ENDDO
                     2. . SEARCH ZONES IN PRIORITY ORDER(1-5)
                            TO GET OUT AS SOON AS POSSIBLE
     L=L+1
*                    1. ENDDO
   ENDDO
*                    1. IF INTERSECT FOUND, THEN
   IF TIMP-=Ø THEN
*                    2. . RESET TO ZONE WHERE INTERSEGT WAS
                            FOUND
     L=L-1
*                    2. . IF TYPE IS LINE GRAPH THEN
     IF CHART-TYPE=LINE THEN
*                    3. . . CALCULATE INDEX INTO TABLE OF LINE
                             GLYPH BEST-DOT CONSTANTS USING
                             LINE TYPE (1 TO 4) AND BEST-DOT
                             MASK SELECTED (L=1 TO 5)
       K=(BABC*(LTYP-1))+2*(L-1)
*                    3. . . INSERT 2 BYTES OF LINE GLYPH
                             CONSTANT INTO INTERNAL IMAGE
                             ARRAY
       II(IROW,ICOL,1)=BDL(K)
       II(IROW,ICOL,2)=BDL(K+1)
*                    2. . ELSE TYPE IS PIE GRAPH
```

```
      ELSE
*                    3. . . CALCULATE INDEX INTO TABLE OF PIE
                              GLYPH BEST-DOT CONSTANTS USING
                              BEST DOT MASK SELECTED (L= 1 TO
                              11)
        K=2*(L-1)
*                    3. . . INSERT 2 BYTES OF PIE GLYPH
                              CONSTANT INTO INTERNAL IMAGE
                              ARRAY
         II(IROW,ICOL,1)=BDP(K)
         II(IROW,ICOL,2)=BDP(K+1)
*                    2. . ENDIF
      ENDIF
*                    1. ENDIF
    ENDIF
*                    END BDOT
  END BDOT
```

We claim:

1. Apparatus for displaying curvilinear graphics on a non-all points addressable computer display in which character images are selected from a predefined character set and displayed within addressable character positions called character boxes, said apparatus comprising:

first means for storing a predetermined minimum number of first graphics characters which are substantially identical except for their relative positions within a character box;

means for assigning shift attributes to any of said first graphics characters to thereby effectively increase the number of said predetermined minimum number of first graphics characters by shifting their relative positions within a character box;

means for mapping a desired curvilinear graphics display onto an internal image character box display by selecting for each character box one of said predetermined minimum number of first graphics characters from said first means and storing said selected one of said first graphics characters with a shift attribute assigned by said means for assigning which most closely approximates the desired curvilinear graphics display for that character box; and means for displaying the selected first graphics characters shifted according to their assigned shift attribute on said non-all points addressable computer display.

2. The apparatus according to claim 1 further comprising:

second means for storing a plurality of character-attribute byte pairs identifying the selected graphics characters to be generated and whether or not they are shifted;

generating means, in said means for displaying, responsive to the character byte for generating the selected character; and shifting means, in said means for displaying, responsive to the attribute byte of said character-attrubute byte pair for shifting the positions of at least some of the generated graphics characters.

3. The apparatus according to claim 2 wherein the attribute byte of said character-attribute byte pair in addition to indicating whether or not a character is shifted, indicates whether or not a character is brightened, said apparatus further comprising brightening means, in said display means, responsive to said attribute byte to brighten at least some displayed graphics characters.

4. The apparatus according to claim 2 wherein said means for generating includes a character generator read only storage storing at least four graphics characters each located in a different relative position of a character box which when combined with the shift attribute provide at least eleven graphics characters which may be displayed on said computer display.

5. The apparatus according to claim 3 wherein said means for generating includes a character generator read only storage storing at least four graphics characters each located at predetermined relative positions in a character box which when combined with the attributes of shifting or brightening provide effectively at least twenty graphics characters which may be displayed on said computer display.

6. The apparatus according to claim 1 wherein said means for mapping comprises:

first storage means for storing character box data to be displayed on said computer display;

second storage means for storing data representative of high resolution graphics in the form of a bit array; and means for converting high resolution graphics data in said second storage means to graphic character data and storing said graphic character data in said first storage means.

7. The apparatus according to claim 1 further comprising:

second means for storing a predetermined minimum number of second graphics characters which are substantially identical except for their relative positions within a character box;

said means for assigning shift attributes also assigning said shift attributes to any of said second graphics characters to thereby effectively increase the number of said second graphics characters by shifting their relative positions within a character box, said first graphics characters being dots and including the character for a period, and said second graphics characters being small open circles and including the character for a degree symbol.

8. The apparatus according to claim 7 further comprising means for assigning brightness attributes to any of said first or second graphics characters to thereby effectively increase the number of said first and second graphics characters by either shifting their relative locations within a character box or changing their relative brightness or both shifting their relative locations within a character box and changing their relative brightness.

* * * * *